US006119307A

United States Patent [19]

Weishar et al.

[11] Patent Number: 6,119,307

[45] Date of Patent: Sep. 19, 2000

[54] OVERHEAD DOOR WITH A PLUNGER ASSEMBLY HAVING A WEAR INDICATOR AND IMPROVED PANEL CONSTRUCTION

[75] Inventors: William B. Weishar, Brookfield; Jeremy Becker, Menomonee Falls; Eric Westfall, Greendale, all of Wis.

[73] Assignee: United Dominion Industries, Inc., Charlotte, N.C.

[21] Appl. No.: 09/130,793

[22] Filed: Aug. 7, 1998

[51] Int. Cl.[7] ..... E05D 15/00

[52] U.S. Cl. ..... 16/87 R; 16/91; 16/106; 16/229; 16/97; 160/201

[58] Field of Search ..... 16/91, 87 R, 106, 16/102, 229, 42 R, 97; 160/201, 264, 310, 133, 280–289

[56] References Cited

U.S. PATENT DOCUMENTS

| | | |
|---|---|---|
| D. 245,266 | 8/1977 | Gorse . |
| 1,787,451 | 1/1931 | Mohun et al. . |
| 2,252,737 | 8/1941 | Siess . |
| 3,118,189 | 1/1964 | Dugger . |
| 3,192,992 | 7/1965 | Hasselmark . |
| 3,339,619 | 9/1967 | Crosswell . |
| 3,648,755 | 3/1972 | Thiele . |
| 3,967,671 | 7/1976 | Stanley et al. . |
| 4,156,448 | 5/1979 | Bengtsson . |
| 4,320,793 | 3/1982 | Lindbergh . |
| 4,452,293 | 6/1984 | Gorse . |
| 4,676,293 | 6/1987 | Hanssen . |
| 4,855,567 | 8/1989 | Mueller . |
| 4,880,045 | 11/1989 | Stahler . |
| 4,924,932 | 5/1990 | Esnault . |
| 4,957,301 | 9/1990 | Clay, Jr. et al. . |
| 5,025,847 | 6/1991 | Mueller . |
| 5,139,075 | 8/1992 | Desrochers . |
| 5,141,043 | 8/1992 | Kraeutler . |
| 5,141,044 | 8/1992 | Hying et al. . |
| 5,163,494 | 11/1992 | MacNeil et al. . |
| 5,168,915 | 12/1992 | Lafleur . |
| 5,219,015 | 6/1993 | Kraeutler . |
| 5,222,541 | 6/1993 | Hornberger . |
| 5,535,805 | 7/1996 | Kellogg et al. . |
| 5,584,333 | 12/1996 | Torchetti et al. . |
| 5,718,276 | 2/1998 | Rekret . |

FOREIGN PATENT DOCUMENTS

| | | |
|---|---|---|
| 247856 | 6/1960 | Australia . |

*Primary Examiner*—Chuck Y. Mah

*Attorney, Agent, or Firm*—Adams, Schwartz & Evans, P.A.

[57] ABSTRACT

An overhead door having two tracks each of which is designed to be mounted on the side of an opening in a building. Each track has a script-v shape in cross-section, and a groove or channel that runs along its longitudinal axis. One or more panels are positioned between the tracks and coupled to each other. Each panel has a multiple-layer design that provides superior insulation. At least two plungers are positioned on each panel and each plunger has a first end which is biased in a first position. In the first position, the first end of the plunger rides within the channel of the track. The plungers are designed with a low-friction tip that wears away after repeatedly traveling in the channel of the track. The plungers may be designed to release from the track when the panel on which they are mounted is impacted, to rotate in whole or in part as they travel in a channel of a track, or both.

10 Claims, 7 Drawing Sheets

OVERHEAD DOOR WITH A PLUNGER ASSEMBLY HAVING A WEAR INDICATOR AND IMPROVED PANEL CONSTRUCTION

FIELD OF THE INVENTION

The present invention relates to overhead doors. More specifically, the present invention relates to an overhead door that has a plunger that slides within a specially-grooved track and is part of a plunger assembly that releases the plunger from the door's tracks when the door is impacted, thereby preventing damage to the door, tracks, and surrounding supporting structures.

BACKGROUND OF THE INVENTION

Overhead doors are used to occlude openings in structures such as warehouses, factories, and other commercial establishments. Doors are typically used at loading docks and are often subject to impacts from fork lifts, other loading devices, and freight. Such impacts often cause damage to an overhead door and sometimes to the building structure supporting the door. A variety of impact-resistant doors have been developed in response to this problem. For example, U.S. Pat. No. 5,584,333, issued to Torchetti et al., and U.S. Pat. No. 5,025,847, issued to Mueller, disclose assemblies designed to lessen the damage caused by an impact to a door.

While these and other prior-art devices have operated with some degree of success, they have several shortcomings. The impact resistant assemblies shown in U.S. Pat. No. 5,025,847, while operable to release from an associated track upon being exposed to force of a predetermined magnitude, are relatively complex in their mechanical arrangement. Complex door designs, of course, greatly increase the cost of manufacturing and maintaining an overhead door. Further, the door design taught by U.S. Pat. No. 5,584,333, while useful for reducing the damage to a flexible, bottom panel, is not appropriate for all applications, particularly those where a door with relatively rigid panels is desired.

Another shortcoming with prior-art doors is that they are constructed from relatively costly materials. For example, the door shown in U.S. Pat. No. 5,535,905, issued to Kellogg et al., includes extruded plastic tracks which are made from a relatively expensive low-friction material. In addition, the panels used in the door are made from numerous parts and relatively expensive non-metallic materials, including polycarbonate and fiberglass. While these doors are extremely sturdy, there are many instances where such a robust door is not required, and a lower-cost door would be more attractive to overhead door customers.

A further shortcoming with prior-art doors is that they do not provide sufficient thermal resistance (or insulation value). As should be apparent, the large openings in loading bays are a significant source of heat transfer (usually heat loss). Even when such openings are closed, heat transfer occurs through the doors themselves and through small openings around their edges and at their joints. A door with improved heat transfer resistance would reduce heat transfer and, therefore, the energy costs associated with maintaining a desired temperature within the building in which the door is located.

Therefore, it would be desirable to have an improved overhead door designed to release from its tracks when exposed to a force of a predetermined magnitude in order to limit or prevent damage to the door, its track, and surrounding structure. Further, it would be desirable if the door had a simple design with relatively few components and could be manufactured from relatively inexpensive materials so as to reduce the overall cost of the door. Further still, it could be desirable if the door had superior insulation characteristics.

OBJECTS AND SUMMARY OF THE INVENTION

Therefore, it is an object of the present invention to provide an overhead door that reliably releases its door panels from their tracks when the panels are exposed to force of a predetermined magnitude.

Another object of the present invention is to provide an overhead door of relatively simple design which can be manufactured from relatively inexpensive materials so as to reduce the overall cost of the door.

Another object of the present invention is to provide an overhead door with pins that slide in a channel or groove of a metal track and which arc further equipped with a wear indicator.

Another object of the present invention is to provide an overhead door that includes a release assembly having a plunger that is biased in an engaged position relative to an associated track and, when exposed to force of a predetermined magnitude, is operable to move to a disengaged position to release the overhead door from the track and prevent damage to the overhead door and the associated track.

Another object of the present invention is to provide an overhead door assembly which has an improved panel construction which provides the panels with a higher insulation value in comparison to prior-art door panels.

These and other objects and advantages are achieved in an overhead door having two racks. In use, one track is mounted on each side of an opening in a building and the tracks are positioned so as to be substantially parallel to one another. Each track is constructed of a relatively inexpensive, but strong material such as galvanized steel. Each track has a script-v shape in cross-section and a groove or channel that runs along its longitudinal axis.

A plurality of panels is positioned between the two tracks. Each panel consists of an outer layer of fiberglass, an inner layer of aluminum or polyethylene, and a layer of cellular polystyrene (such as Styrofoam polystyrene) sandwiched therebetween. One of the advantages of this design is that the thickness of the layer of cellular polystyrene may be adjusted in order to provide the insulation value desired by the purchaser of the door. If a high insulation value is desired, a relatively thick layer of cellular polystyrene may be used. On the other hand, if a low insulation value is desired, a relatively thin layer of cellular polystyrene may be used.

The panels are connected to one another by a plurality of hinges mounted on the interior surface of each panel. At least three hinges are used to couple two panels together. One hinge is mounted on the respective left and right ends of the panels and another is mounted in between the first two. At least two guide assemblies are mounted on each door panel. A first guide assembly is mounted on the inwardly facing surface near the first end of the panel and a second assembly is mounted in the inwardly facing surface near the second end.

Each guide assembly has a plunger with a first end biased in a first position where the plunger extends beyond the edge of the panel. Each plunger includes a metal shaft and a tip made from a plastic material that wears away when subjected to frictional sliding. The metal shaft may include one or more circumferential rings around its first end. The plastic tip is placed over the first end of the shaft. When the door is opened and closed, the tips slide along the bottom of the channels in the tracks. Further, when the door is impacted, the tips slide along the disengagement surface of each track. The plastic provides a relatively slippery surface to facilitate movement of the plunger and prevent metal-on-metal contact of the shaft and track. However, when the plunger moves, the plastic tip is subjected to frictional wear. To prevent metal-on-metal contact, the plunger may be provided with a wear indicator which once visible provides a signal that the tip has worn to an undesirable level. For example, if the tip wears away to a point where the shaft is visible, then the plunger should be replaced.

In an alternate form of the present invention, the plastic tip includes a first, outer layer of plastic material having a first color and a second, inner layer of plastic material having a second color that is different from the color of the first, outer layer of plastic material. When the outer layer wears away, the differently colored inner layer is exposed to provide a visual wear indicator for maintenance personnel. Once the second, inner layer of the plastic tip is visible, the plunger should be replaced.

One of the advantages of the present invention is that it may be manufactured from low-cost materials. In prior doors, a relatively low-friction track, typically plastic, is used in connection with metal pins or plungers. The plastic track provides a surface upon which a metal pin may easily slide. However, as noted above, plastic track is relatively expensive. In the present invention, plastic tips are placed on the plungers and low-cost steel tracks are used. Thus, the overall cost of the overhead door is reduced.

These are just some of the features and advantages of the present invention. Many others will become apparent by reference to the detailed description of the invention taken in combination with the accompanying drawings.

DETAILED DESCRIPTION

Figure 1:
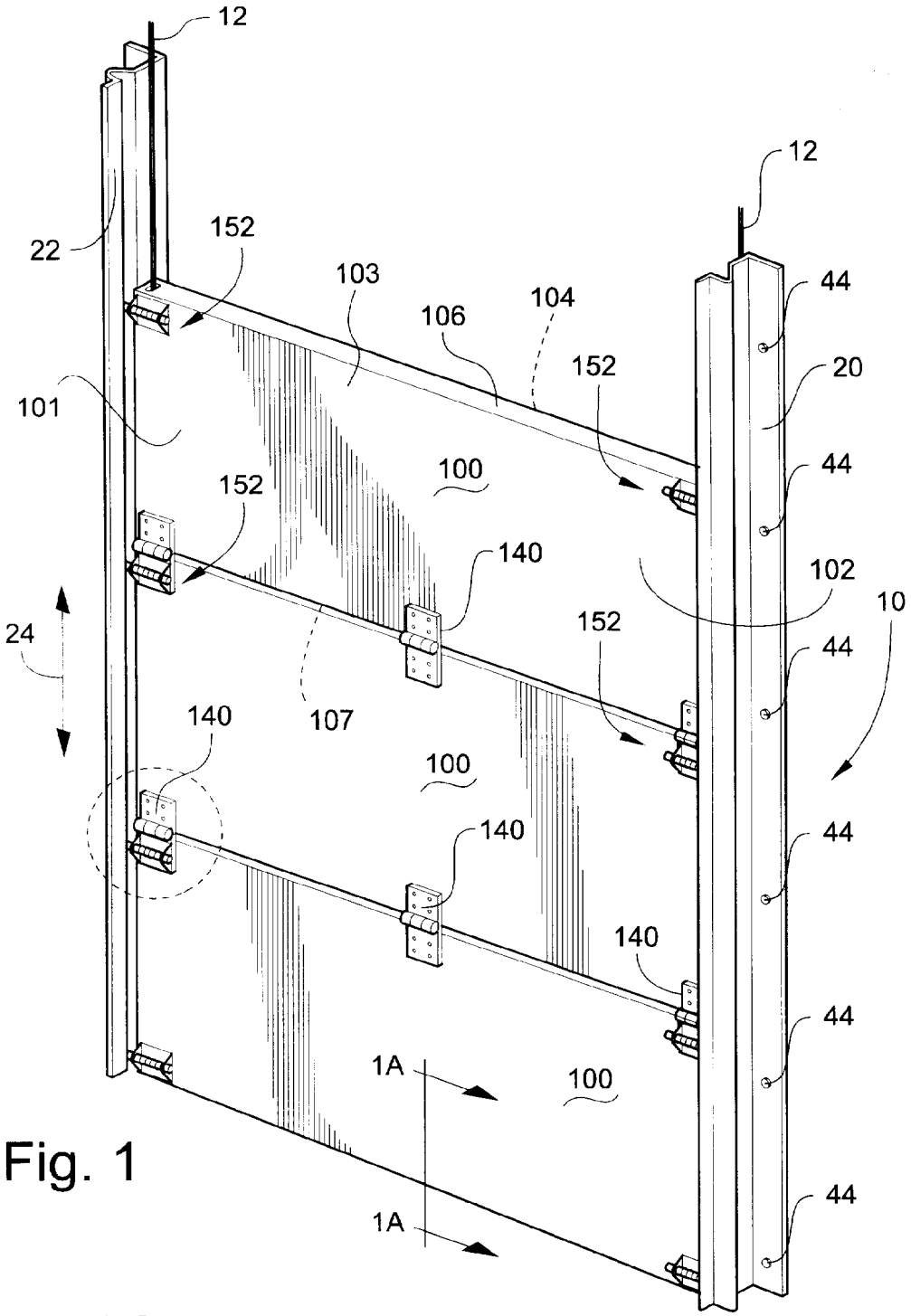
FIG. 1 is a perspective, environmental view of an overhead door of the present invention.

An overhead door 10 of the present invention is shown in FIG. 1. The overhead door 10 is designed to be installed in an opening (not shown) of a building (also not shown) and is particularly useful as a door for a loading dock, such as those found in warehouses, manufacturing facilities, and the like. Although not shown, the overhead door 10 is designed to be used with a torsion spring counterbalance or retraction assembly, of substantially conventional design, mounted in a predetermined position above the door. A retraction assembly useful with the present invention may have an axle assembly, one or more take-up pulleys, one or more torsion springs, and one or more cables 12 fastened to the cable drums of the take-up pulleys and the overhead door 10 to lift or move the overhead door 10 into an open position (not shown), or otherwise permit the overhead door 10 to be positioned at any desired location, thereby selectively occluding an opening in a building,.

The overhead door 10 of the present invention includes a pair of tracks 20 and 22, each of which is substantially identical to one another and designed to be fastened on the wall 23 (FIG. 3) of a building. The tracks 20 and 22 are disposed in predetermined, substantially parallel spaced relation one to the other and define a predetermined path of travel 24 for the overhead door 10. While the path of travel 24 is shown as a substantially linear path, the overhead door may follow a curved path of travel as where the door moves along the tracks into a position which is substantially parallel to the floor of the building. This type of installation would typically be utilized in buildings having relatively low interior ceilings.

Figure 3:
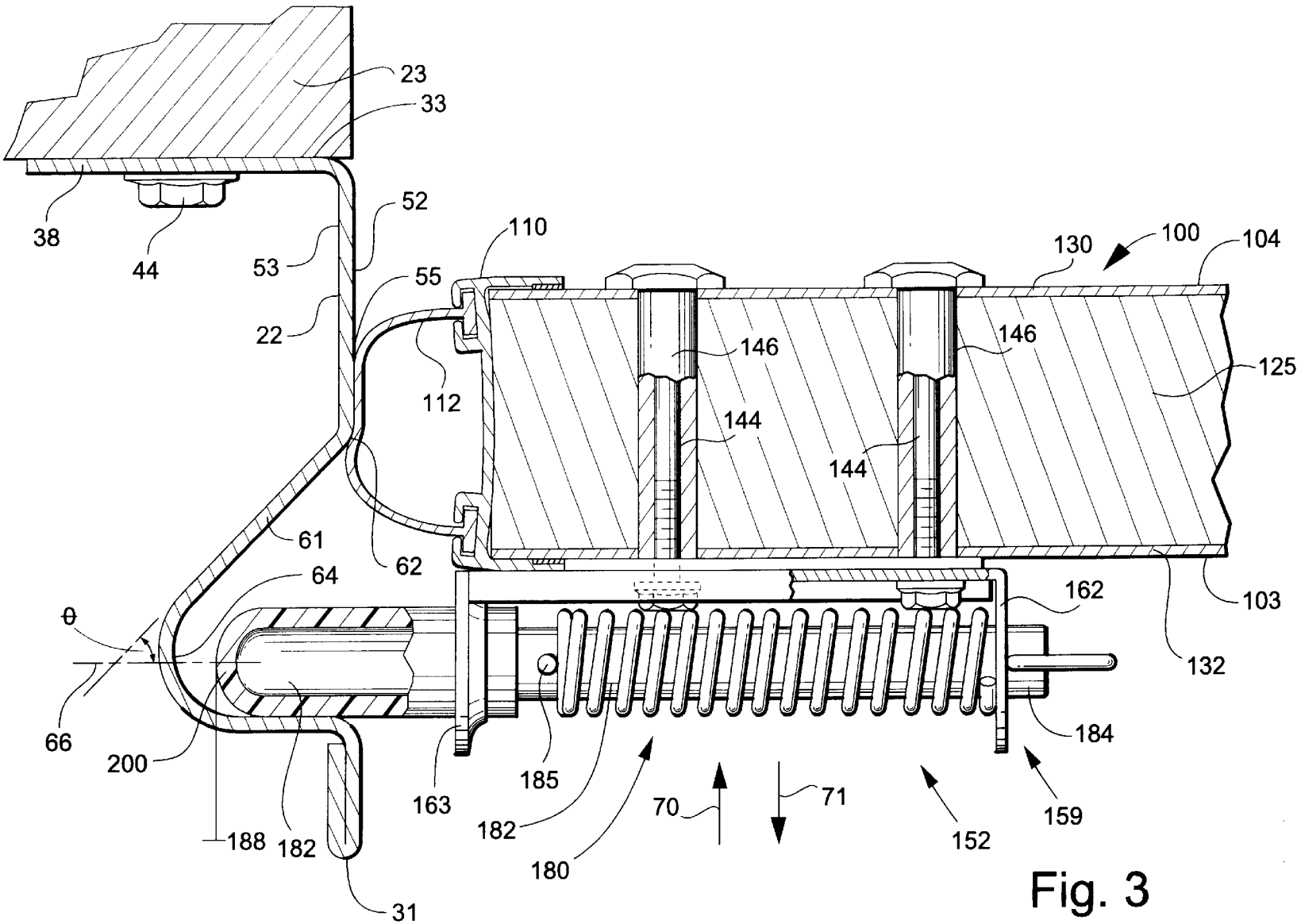
FIG. 3 is a cross-sectional view of a plunger and door panel used in the present invention taken along the line 3—3 of FIG. 2.

As best seen by reference to FIG. 3, each track has a first edge 31, a second edge 33, is shaped like a script v in cross section, and has a leg 38. Each is made of a relatively rigid material such as galvanized or stainless steel and may be fixed to a building by a plurality of fasteners 44, inserted through openings in the leg 38.

Each track also has inwardly and outwardly facing surfaces 52 and 53, respectively. The inwardly facing surface 52 defines an engagement surface 55 having an angled disengagement portion 61 which continues smoothly to a disengagement point 62. The engagement surface 55 defines a u-shaped channel 64 which extends along the longitudinal axis of the track and has a center line 66 which is substantially perpendicular to the longitudinal axis of the track. The angled disengagement portion 61 is aligned at an acute angle $\theta$ with respect to the centerline 66 of the channel 64.

Each track 20, 22 is operable to release a plunger (discussed below) when force is applied in the direction indicated by the arrow labeled 70. However, the tracks can render the overhead door 10 operable to release in the opposite direction by merely installing the respective tracks in reversed, end-to-end orientation. When so installed, the overhead door 10 is operable to release when force is applied in the direction indicated by the arrow labeled 71. Thus, the present design permits the installer to select the direction of release without requiring additional parts. Further, the individual tracks 20, 22 may have mixed sections, that is, sections which provide for release when struck in one direction when the door is at a first position, and which provide for release in the opposite direction when the overhead door 10 is oriented at a different position above the floor of the building in which it is installed. Of course, if the overhead door 10 is installed in a fashion where the door, when open, is positioned in substantially parallel relation to the floor of the building, the tracks would be oriented such that the weight of the overhead door would not cause the overhead door to release from the tracks.

The tracks 20, 22 may be shaped in such a manner that the track facilitates release of the overhead door 10 when force of a predetermined magnitude is applied in either of the directions indicated by the arrows 70 and 71. A track so shaped is shown in U.S. Pat. No. 5,535,805, the disclosure of which is hereby incorporated by reference. Modification of the tracks 20 and 22 to function so as to release a door panel upon impact from either of two opposite directions based on the disclosure of U.S. Pat. No. 5,535,805, would be within the knowledge of those skilled in the art.

One or more panels 100 (FIGS. 1 and 3) are mounted to each other and positioned between the tracks 20 and 22. Each panel 100 has a first end 101, a second end 102, an inwardly facing surface 103, an outwardly facing surface 104, a top 106, and a bottom 107. As best seen by reference to FIG. 3, a side seal 110 with a U-shaped member 112 is fitted on the first and second ends 101 and 102 of each panel 100. The side seals 110 contact the engagement surface of the tracks and help prevent air and moisture flow around the edges of the door 10.

Figure 1A:
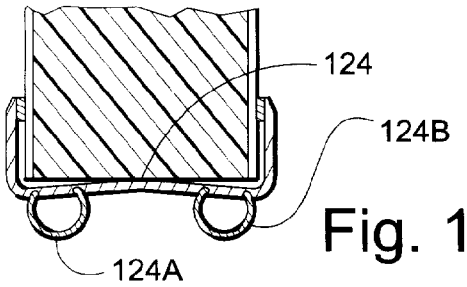
FIG. 1A is a partial, cross-sectional view of the seal used on the bottom panel of the overhead door shown in FIG. 1.
Figure 2:
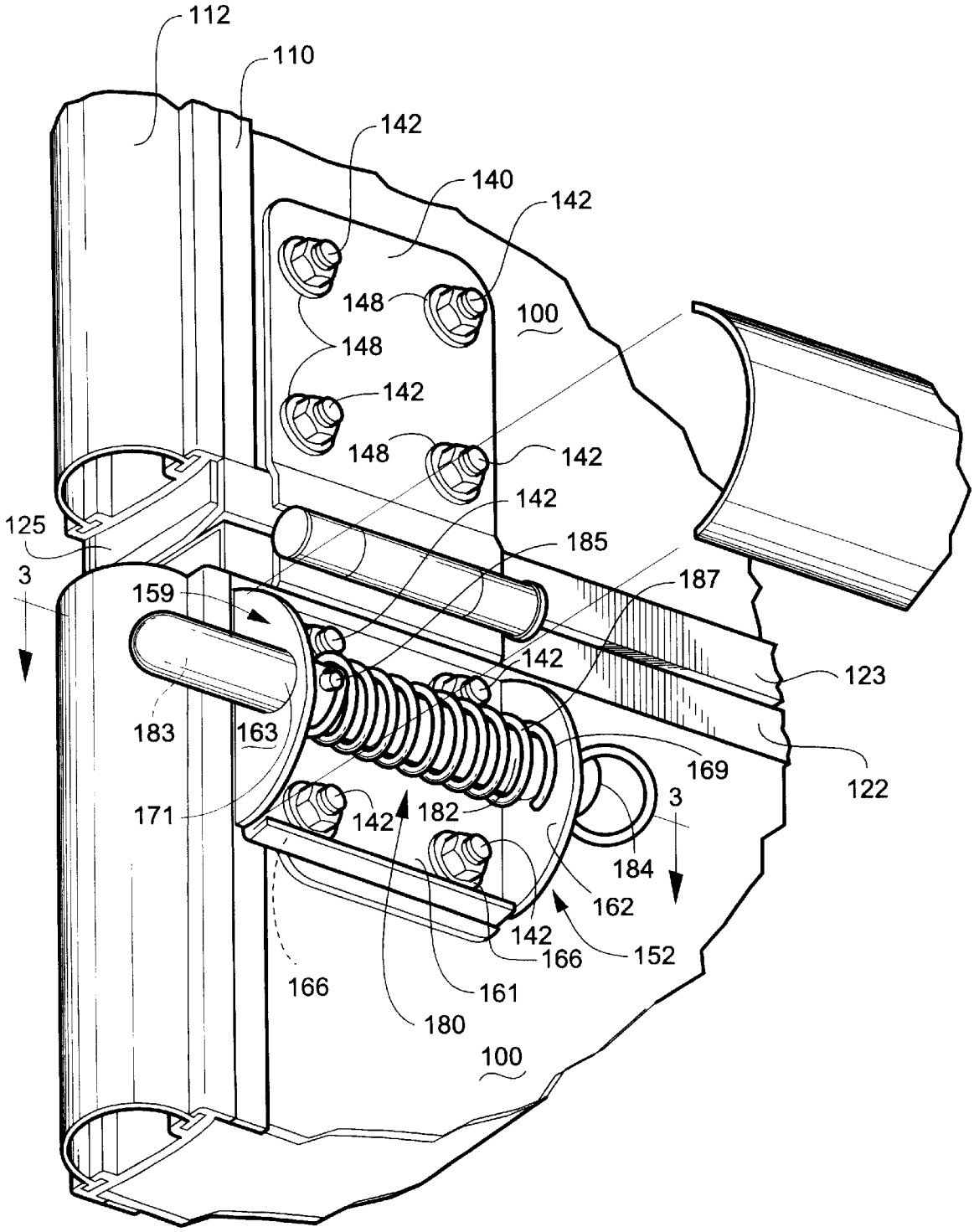
FIG. 2 is a greatly enlarged view of a portion of the door of FIG. 1 showing a hinge and guide assembly used in the present invention.

A cap 122 (FIG. 2) is fitted on the top 106 of each panel 100 and a flexible seal 123 is fitted on the bottom 107 of each panel 100. The cap 122 and seal 123 form a substantially air and water tight seam between each panel which helps reduce heat and moisture exchange between the inwardly facing and outwardly facing surfaces 103 and 104 of each panel 100 and, thus, between the interior of the building in which the door is installed and the environment outside the building. As shown in FIG. 1A, a more rugged seal 124 having two sealing members 124A and 124B may be mounted on the bottom of the lowest door panel or the top of the highest panel to provide improved sealing between the door and the ceiling, as the case may be.

Referring again to FIG. 3, each panel 100 includes a core 125 of cellular polystyrene such as Styrofoam polystyrene which may be two and one half inches thick. Thicker or thinner pieces of polystyrene may be used depending on the insulation value desired for the panel. Increasing the thickness of the core 125 increases the insulation value for each panel 100. Conversely, decreasing the thickness of the core 125 decreases the insulation value for each panel 100.

The core 125 is sandwiched between an outer layer or sheet of fiberglass 130 and inner layer or sheet of aluminum or, alternatively, polyethylene 132. The fiberglass sheet 130 and sheet 132 are glued to the core 125 using commercially available adhesives such as urethane/epoxy.

Figure 6:
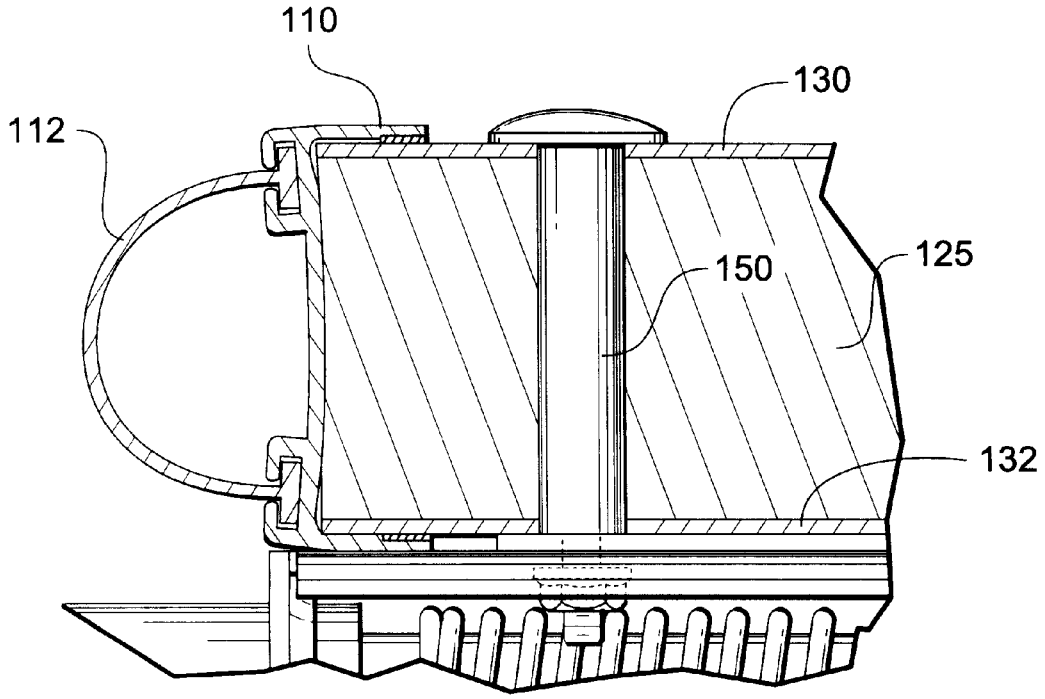
FIG. 6 is a cross-sectional view of a panel of the present invention with a specially designed spacer bolt.

Each panel 100 is connected to another panel 100 by a plurality of hinges 140. As shown in FIG. 1, three hinges 140 connect two panels to one another. One hinge is mounted at the first end 101, a second hinge is mounted at the second end 102, and a third hinge is mounted in between the first two. As best seen by reference to FIGS. 2 and 3, each hinge 140 is of substantially conventional design and is bolted to two panels 100 by means of eight bolts 142 inserted through bores 144 in the core 125. A spacer 146 is placed in each bore 144 in order to maintain its dimensions and prevent compression of the core 125 by over tightening of nuts 148 on the bolts 146. Alternatively, the door 10 may be constructed with bolts 150 (FIG. 6), which are designed so as to prevent over-tightening of nuts on them and, thereby, maintain the desired thickness of the core 125.

Each panel 100 also has two or more guide assemblies 152. Each guide assembly 152 holds a single plunger (discussed below) and is mounted in close proximity to either the first end 101 or the second end 102 of each panel. While at least two guide assemblies 152 are shown mounted on each panel 100 in the drawings, four guide assemblies may be used in some applications due, in part, to the size of the door panel employed.

The individual guide assemblies include a bracket 159 having a mounting plate 161 (FIGS. 2 and 3) and side walls 162 and 163. The sidewalls 162 and 163 are disposed in predetermined substantially parallel, spaced relation one to the other. The mounting plate 161 has a plurality of apertures 166 positioned in a predetermined pattern and which accommodate individual fasteners (e.g. bolts 142) to secure each mounting plate 161 to the underlying door panel 100. The fasteners may be manufactured from a frangible material which will shatter or otherwise break when exposed to a shearing force of a predetermined magnitude. When so designed, the fasteners provide additional safety against damage to the overhead door 10 when, for whatever reason, the plungers do not release from the tracks 20, 22.

The sidewalls 162 and 163 each have an aperture 169 and 171, respectively, and a plunger 180 is received in the apertures 169 and 171. Each plunger 180 has a shaft 182 with a first end 183, a rear end 184, and a stop 185. A biasing means, preferably a spring 187, is biased between the wall 171 and the stop 185 and biases the end 183 of the plunger 180 at a position 188.

Figure 4:
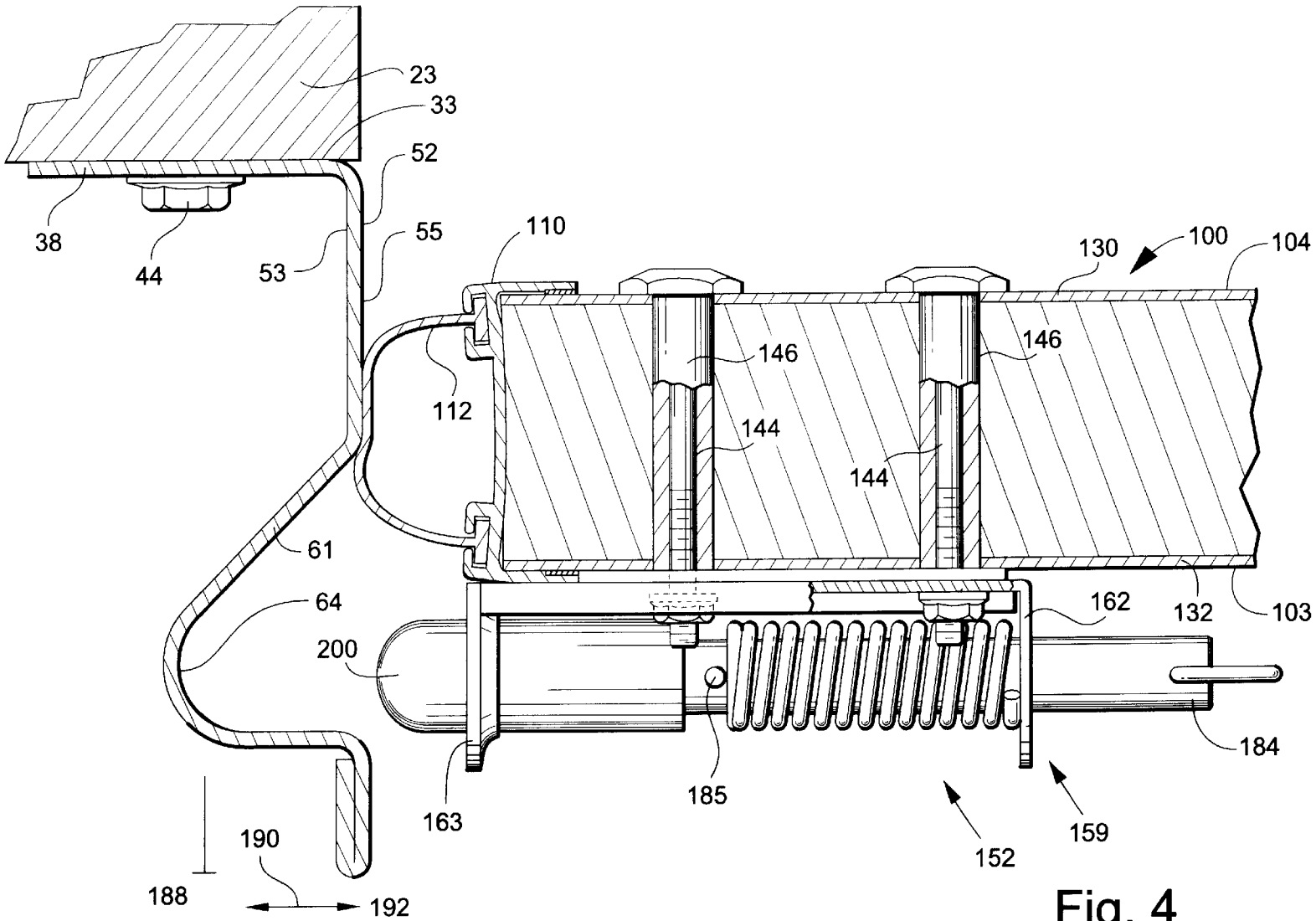
FIG. 4 is a cross-sectional view of a plunger and door panel used in the present invention taken along the line 3—3 of FIG. 2 showing the plunger disengaged from the track.

In the position 188, the first end 183 engages the track 20 or 22, depending on which end of the panel the guide assembly 152 is mounted. The plunger 180 is reciprocally moveable along a predetermined path of travel 190 (FIG. 4) between the first, engaged or extended position 188, as shown in FIG. 3, where it is received in the channel 64, to a second, depressed or releasing position 192, shown in FIG. 4. In the second position 192, the plunger assembly is urged backwardly against the force of the biasing spring 187. When moving toward the second position 192, the plunger 180 is also urged along the engagement surface 55 following the application of force of a predetermined magnitude to the door panel 100. The plunger is specifically designed to react to force that acts in a plane that is substantially perpendicular to the door panels. When the force is of sufficient magnitude, the plunger 180 is forced rearwardly until the door panel 100 is released from the track 20, 22, or both, thereby avoiding damage to the overhead door 10, the tracks 20, 22 or any surrounding assemblies or structures. To reset the overhead door in the tracks, an individual merely grasps the rear end 184 of the shaft 182 and pulls it rearwardly, thereby permitting the plunger 180 to be moved into engagement with the u-shaped channel 64. Biasing springs of different strengths can be selected to adjust the door to release at any one of many desired levels of force. In the present design, it has been found that springs that exert about 15 to about 25 lbs. of force should be used to affect proper release of the door 10. This level of force is required due, in part, to the low weight of the panels 100.

The first end 183 of each plunger 180 has a tip 200 which is made from plastic which is placed on the plunger 180 and held in place by a friction fit. Preferably, the plastic material from which the tip 200 is made is acetal resin plastic and has a coefficient of friction with respect to metal of about 0.300. In an alternative embodiment (not shown), the plunger in the guide assembly may include one or more circumferential rings around its first end and the plastic tip covering it may be injection molded over the rings. Regardless of how it is placed on the plunger, the plastic tip 200 provides a relatively slippery surface to facilitate movement of the plunger and prevent metal-on-metal contact of the shaft and track. However, when the plunger moves, the plastic tip is subjected to frictional wear. Specifically, when the door 10 is opened and closed, the tips 200 slide along the bottom of the channels 64 in the tracks 20, 22. Further, when the door is impacted, the tips 200 slide along the disengagement portion 61 of each track.

If not replaced, the tips 200 will eventually wear to a point where the metal shaft 182 contacts the metal tracks 20 and 22. The shaft 182 or rings (not shown) act as wear indicators. If either are visible, the tip has worn to an undesirable level, and the plunger 180 should be replaced.

Figure 5:
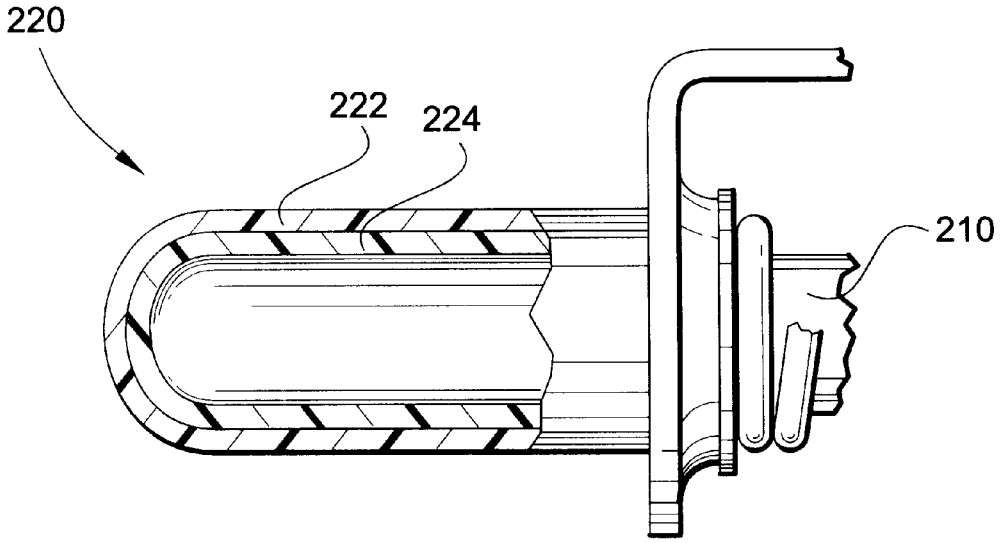
FIG. 5 is a cross-sectional view of an alternative embodiment of a tip used on a plunger of the present invention.

In an alternate form of the present invention, (FIG. 5) a substantially smooth, ring-less plunger 210 having a tip 220 is used in the door 10. The tip 220 is placed on each plunger 210. The tip 220 includes a first, outer layer of plastic material 222 having a first color and a second, inner layer of plastic material 224 having a second color that is different from the color of the first, outer layer of plastic material 222. When the first, outer layer 222 wears away, the differently colored inner layer is exposed to provide a visual wear indicator for maintenance personnel. Once the second, inner layer of material 224 is visible, the plunger 210 should be replaced.

As noted above, although it may be possible to merely re-tip a plunger once it has become worn, it is envisioned that plungers 180 and 210 with worn tips 200 and 220 will be replaced. However, it may be more practical to replace the entire guide assembly holding a worn plunger, rather than an individual plunger. The type of replacement will depend on the situation at hand.

While it is preferable that the plungers 180 and 210 be operable to release from the tracks 20, 22, in some circumstances the need for a releasable or breakaway door does not exceed the cost associated with providing the release mechanisms. In some instances, damage to the door 10 or tracks 20, 22 may be fixed by merely replacing impacted or broken components.

Figure 7:
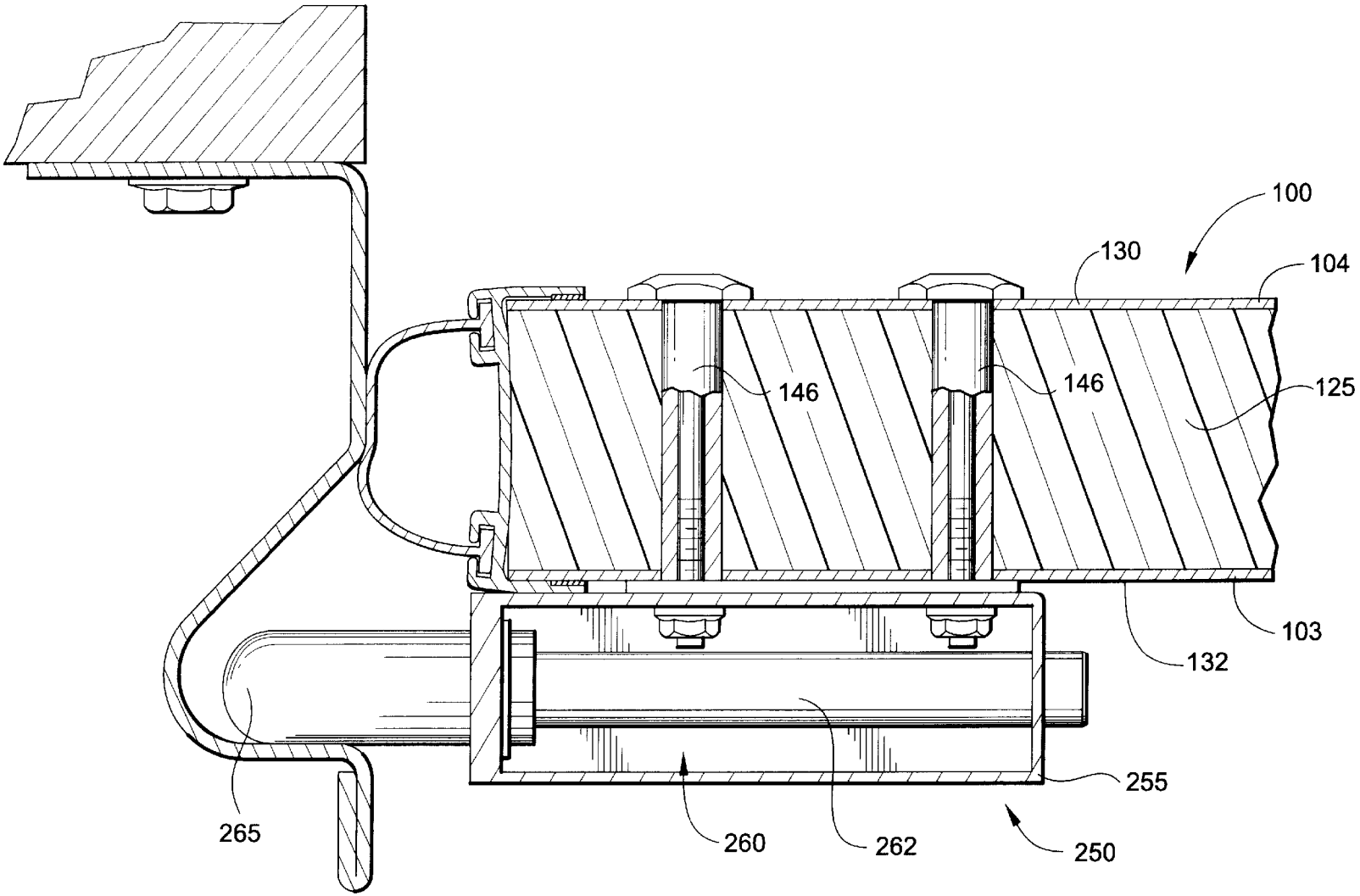
FIG. 7 is a cross-sectional view of an alternative embodiment of a plunger assembly used in the present invention.
Figure 8:
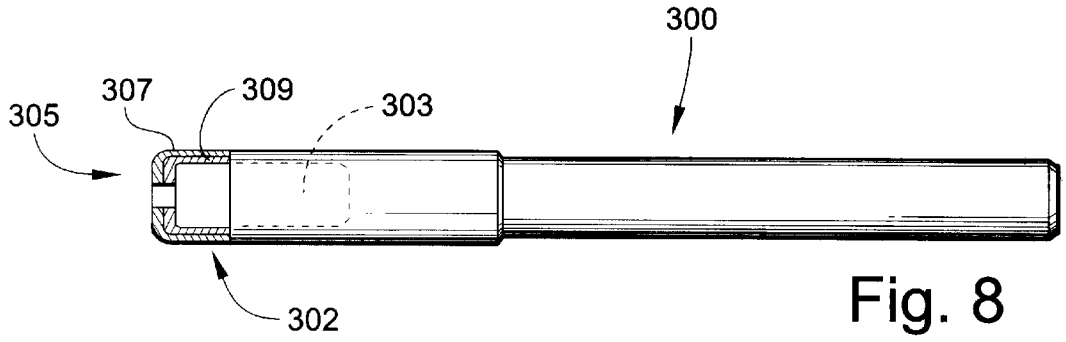
FIG. 8 is a partial cutaway view of first alternative embodiment of a plunger used in the present invention.
Figure 9:
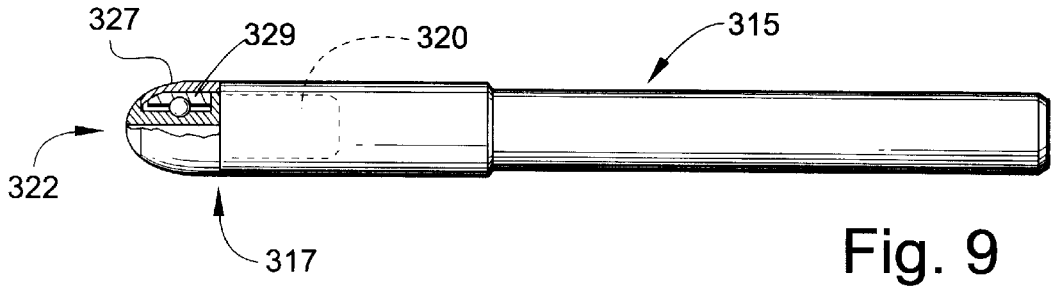
FIG. 9 is a partial cutaway view of second alternative embodiment of a plunger used in the present invention.
Figure 10:
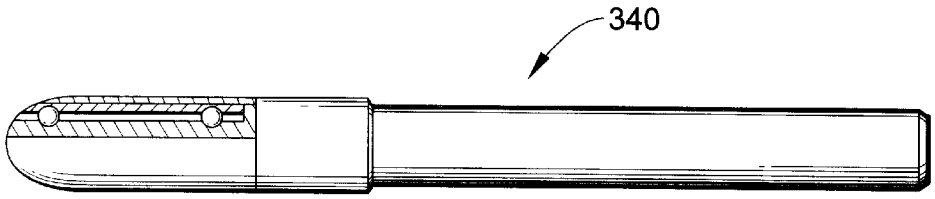
FIG. 10 is a partial cutaway view of third alternative embodiment of a plunger used in the present invention.

Accordingly, a lower cost embodiment of the present invention may be constructed by replacing the guide assemblies 152 with guide assemblies 250 (FIG. 7). Like the guide assemblies 152, each guide assembly 250 has a bracket, housing, or similar mechanism for holding a plunger or pin. Specifically, the guide assembly 250 includes a housing 255. The housing 255 is designed to hold a pin 260. The pin 260 has a shaft 262 (which is fixed in the housing 255) and a head 264. The pin 260 is positioned so that the head 264 extends outwardly from the housing and, when the guide assembly 200 is mounted on a door panel, the head 264 rides in the channel 63 of one of the tracks 20, 22. Since the pin 260 is fixed in position, it will not release from its track when the door 10 is impacted. However, as noted above, if the door panels 100 or other components are damaged during an impact, they may be removed and replaced.

The embodiments of the invention described thus far may be modified even further. FIGS. 8–11 illustrated four types of plunger which may be used in the present invention. The plungers shown in FIGS. 8–10 include mechanisms that permit their tips to rotate. These plungers may be mounted in guide assemblies and mounted on the panels of a door. The rotation of the tips of the plungers or pins provides for a rolling-frictional engagement with the tracks of the door rather than a sliding frictional engagement. Plunger 300 (FIG. 8) includes a cam-follower mechanism 302 fitted in a bore 303. The tip 305 of the cam-follower mechanism 302 may include two layers of plastic 307 and 309, respectively. These layers provide a wear indicator functionality similar to the layers 222 and 224 on the plunger 210.

Plunger 315 (FIG. 9) includes a bearing assembly 317 fitted in a bore 320. The tip 322 of the bearing assembly 317 may include two layers of plastic material 327 and 329 to provide a wear indicator capability. The plunger 340 (FIG. 10) is similarly constructed and, therefore, is not discussed in detail.

Figure 11:
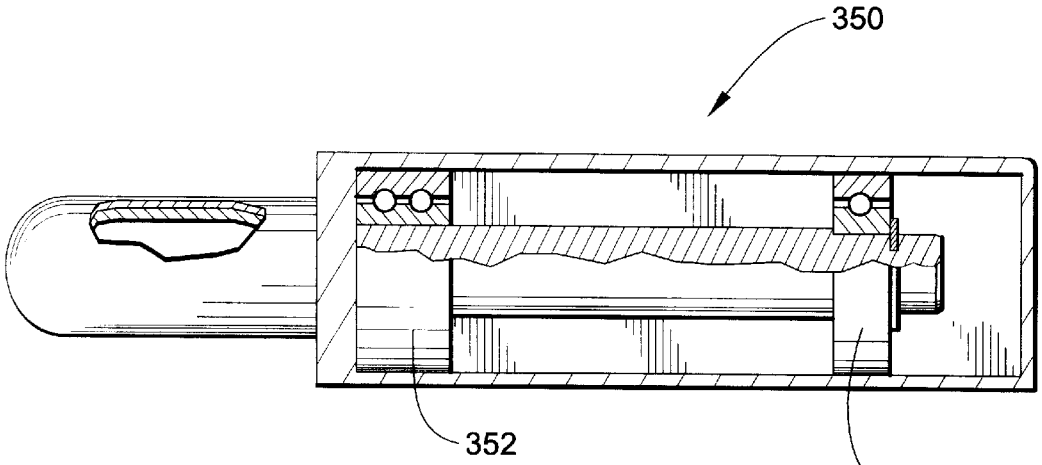
FIG. 11 is a partial cutaway view of fourth alternative embodiment of a plunger used in the present invention.

FIG. 11 illustrates yet another plunger, plunger 350 which is similar to the pin 260. The plunger 350 is mounted in first and second bearing assemblies 352 and 354, respectively. The entire plunger 350 is rotatable within the bearing assemblies 352 and 354. However, it is not moveable along its longitudinal axis. In contrast, the plungers 300, 315, and 340 may be mounted in a housing with a biasing mechanism so that they are moveable along their longitudinal axis. They may be also fitted in a door in a manner like that shown in FIG. 7, fixed so that they have no lateral movement.

As is evident from the description above, the present invention may take the form of one of several embodiments. However, other modifications to various components may be made and would be apparent to those skilled in the art. Thus, while the present invention has been described in what are believed to be the most preferred forms, it is to be understood that the invention is not confined to the particular construction and arrangement of the components herein illustrated and described, but embraces such modified forms thereof as come within the scope of the appended claims.

What is claimed is:

1. A guide assembly for use in an overhead door mounted in a door opening, the guide assembly comprising:

a bracket for being carried by the door;

a pin mounted in the bracket, the pin having a first end and a second end; the first end of the pin including a tip made from a low-friction material subject to observable wear at a predictable rate for indicating the degree of material worn away, the pin adapted to be positioned so that its first end extends beyond the bracket and slides in and frictionally-engages a channel carried in the door opening within which the overhead door is mounted for movement, and further wherein the low-friction material includes an outer layer of a material having a first color and an inner layer of material having a second color that is different from the color of the outer layer of low-friction material, wherein wearing away of the outer layer of low-friction material exposes the inner layer of low-friction material to provide a visual indicator of wear of the tip.

2. A guide assembly as in claim 1, wherein the tip on the first end of the pin comprises a plastic material.

3. A guide assembly as in claim 2, wherein the plastic tip is molded over the first end of the pin.

4. A guide assembly as in claim 1, wherein the first end of the pin is adapted to show through that portion of the tip which has deteriorated due to frictional wear.

5. A guide assembly as in claim 1, wherein the pin mounted for movement in the guide assembly and carries a biasing mechanism for engaging the pin and for biasing the pin into the position where the first end of the plunger extends beyond the bracket.

6. A guide assembly as in claim 1, wherein the pin is fixed in a single position in the bracket.

7. A guide assembly as in claim 1, wherein the pin is rotatable about its longitudinal axis for being rotated by frictional engagement with the channel.

8. A guide assembly as in claim 1, wherein the first end of the pin is rotatable about its longitudinal axis for being rotated by frictional engagement with the channel.

9. A guide assembly as in claim 1, wherein the pin is moveable along its longitudinal axis between a first position, where the first end of the pin extends beyond the bracket, and a second position, where the first end is retracted.

10. A guide assembly as in claim 6 or 9, wherein the first end of the pin includes a plastic tip over it and the first end of the pin shows through the plastic tip when the tip has deteriorated due to frictional wear.

* * * * *